US012012758B2

(12) United States Patent
Waage

(10) Patent No.: US 12,012,758 B2
(45) Date of Patent: Jun. 18, 2024

(54) VARIABLE SPACER SYSTEM OF INSULATED CONCRETE FORMS

(71) Applicant: Mark Waage, Austin, TX (US)

(72) Inventor: Mark Waage, Austin, TX (US)

( * ) Notice: Subject to any disclaimer, the term of this patent is extended or adjusted under 35 U.S.C. 154(b) by 103 days.

(21) Appl. No.: 17/555,360

(22) Filed: Dec. 17, 2021

(65) Prior Publication Data

US 2022/0195732 A1 Jun. 23, 2022

Related U.S. Application Data

(60) Provisional application No. 63/128,862, filed on Dec. 22, 2020.

(51) Int. Cl.
*E04C 5/20* (2006.01)

(52) U.S. Cl.
CPC ..... *E04C 5/206* (2013.01); *E04C 5/203* (2013.01)

(58) Field of Classification Search
CPC .... E04B 2/8641; E04B 2/8647; E04B 2/8617; E04C 5/203; E04C 5/206
See application file for complete search history.

(56) References Cited

U.S. PATENT DOCUMENTS

| | | | | | |
|---|---|---|---|---|---|
| 929,969 | A * | 8/1909 | Murray | E04B 2/30 | 52/564 |
| 2,160,489 | A * | 5/1939 | Spies | E04G 17/06 | 249/43 |
| 4,655,014 | A * | 4/1987 | Krecke | E04B 2/8641 | 52/426 |
| 4,750,308 | A * | 6/1988 | McKay | E04B 2/8641 | 52/379 |
| 2010/0018146 | A1* | 1/2010 | Aube | E04F 13/147 | 52/562 |
| 2017/0121987 | A1* | 5/2017 | Androsiuk | E04G 17/0658 | |

FOREIGN PATENT DOCUMENTS

| | | | | |
|---|---|---|---|---|
| DE | 938750 C | * | 2/1956 | |
| DE | 2001452 A1 | * | 7/1971 | |
| DE | 102012004785 A1 | * | 9/2013 | E04C 5/168 |
| RU | 2126478 C1 | * | 2/1999 | E04B 2/8611 |

* cited by examiner

*Primary Examiner* — Christine T Cajilig
(74) *Attorney, Agent, or Firm* — Tim D. Chheda

(57) ABSTRACT

A variable spacer system of insulated concrete forms includes at least two panels, each panel including at least one cavity beginning at the top of the panel and ending prior to the bottom of the panel. The system further includes at least one spacer able to couple the two panels, when parallel, by entering the cavities at the tops of the panels and resting at the ends of the cavities. The cavities also accept at least one other spacer having the same dimensions as the spacer except a different thickness.

14 Claims, 6 Drawing Sheets

VARIABLE SPACER SYSTEM OF INSULATED CONCRETE FORMS

CROSS-REFERENCE TO RELATED APPLICATIONS

This application claims the benefit of U.S. Provisional Application No. 63/128,862, filed Mar. 22, 2020 and titled "Variable Spacer System of Insulated Concrete Forms" by Mark Waage.

SUMMARY

A variable spacer system of insulated concrete forms includes at least two panels, each panel including at least one cavity beginning at the top of the panel and ending prior to the bottom of the panel. The system further includes at least one spacer able to couple the two panels, when parallel, by entering the cavities at the tops of the panels and resting at the ends of the cavities. The cavities also accept at least one other spacer having the same dimensions as the spacer except a different thickness.

A method of construction using insulated concrete forms includes placing two panels in parallel. Each panel includes at least one cavity beginning at the top of the panel and ending prior to the bottom of the panel. The method further includes sliding at least one spacer between the two panels. The spacer couples the two panels by entering the cavities at the tops of the panels and resting at the ends of the cavities. The cavities are able to accept at least one other spacer having the same dimensions as the spacer except a different thickness.

A variable spacer system of insulated concrete forms includes panels, and each panel includes cavities beginning at the top of the panel and ending prior to the bottom of the panel. The system further includes spacers able to couple the panels, when parallel, by entering the cavities at the tops of the panels and resting at the ends of the cavities. The cavities also accept multiple other spacers having the same dimensions as the spacer except different thicknesses. Identical panels create walls of different thicknesses proportional to the thicknesses of the spacers used in the panels' cavities.

BRIEF DESCRIPTION OF THE DRAWINGS

Systems and methods for a variable spacer system of insulated concrete forms are disclosed herein. In the drawings.

Figure 1:
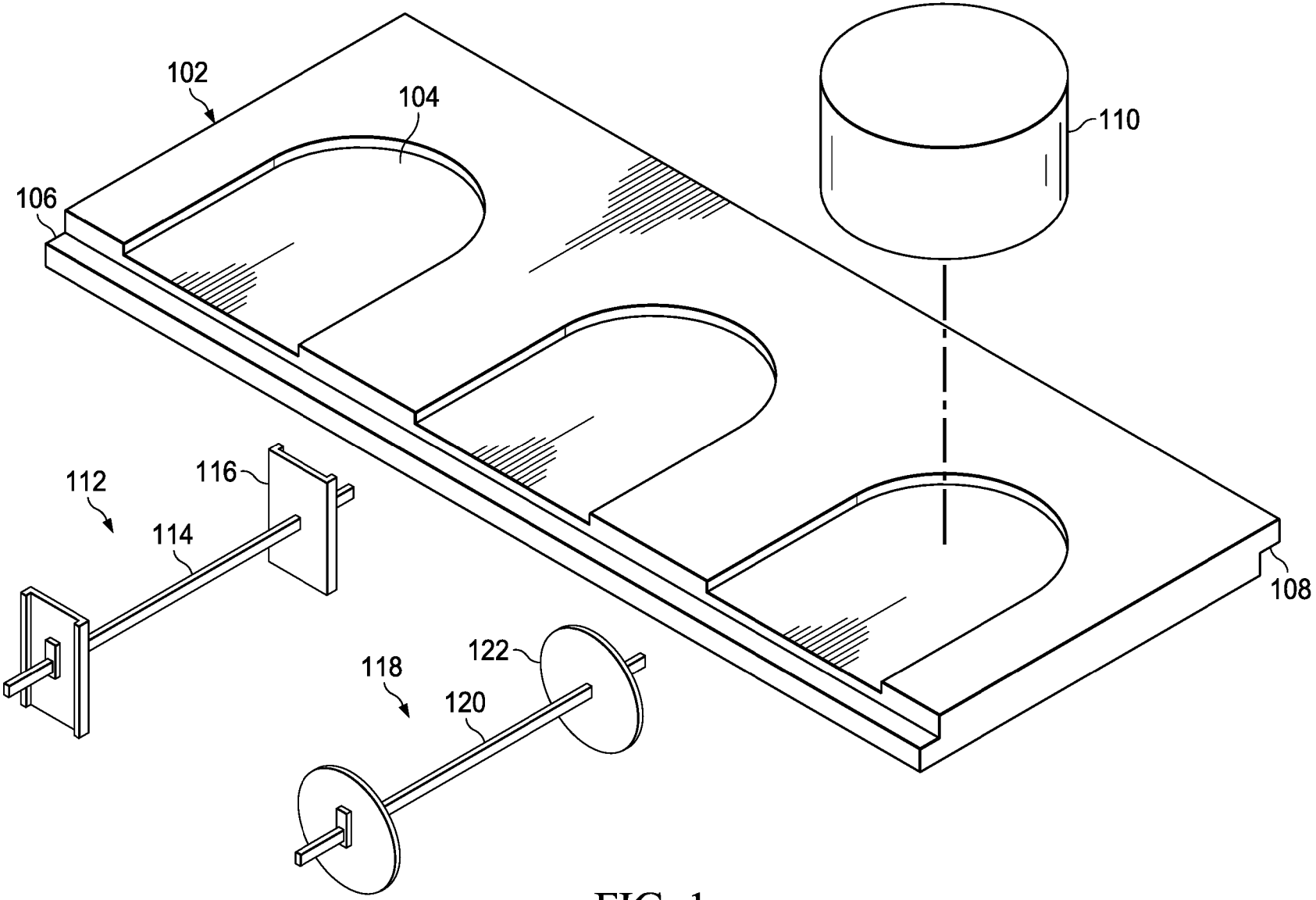
FIG. 1 is a diagram showing components of an illustrative variable spacer system.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

NOTATION AND NOMENCLATURE

Certain terms are used throughout the following description and claims to refer to particular system components and configurations. As one of ordinary skill will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ".

DETAILED DESCRIPTION

Systems and methods for a variable spacer system of insulated concrete forms are disclosed herein. The variable spacer system enables superior construction of walls while minimizing shipping and assembly costs. As will be explained in detail below, the variable spacer system panels are made of lightweight concrete, which reduces shipping and handling costs. Additionally, panels and spacers are shipped separately to reduce shipping damage and further lower shipping costs. Specifically, a pallet consisting of entirely of panels and another pallet of spacers, shipped separately, is 46% less volume than two pallets of assembled blocks thus requiring less space and having less susceptibility to damage. Next, individual panels and spacers are lighter and easier to handle than assembled blocks, reducing labor fatigue. Additional advantages include the panels enabling resistance to fire, insects, rot, and mold, and the panels allowing for easy installation of plumbing and electrical components within and through the resultant walls. Finally, pouring reinforced concrete into a grid around the spacers enables less concrete to be used while simultaneously enabling higher wall strength and less wall damage from storms and floods. As such, the variable spacer systems and methods disclosed herein and described with respect to specific embodiments below increases value while simultaneously reducing cost.

FIG. 1 is a diagram showing components of an illustrative variable spacer system 100 of insulated concrete forms. The system 100 includes multiple panels 102, which can be used interchangeably to construct walls of varying thickness. In at least one embodiment, the panels 102 are made of lightweight concrete. Each panel 102 includes at least one cavity 104 beginning at the top of the panel 102 and ending prior to the bottom of the panel 102. Each panel 102 may include opposite interlocking ridges 106, 108 at the top and bottom of the panel such that multiple panels 102 may be stacked to form a wall.

The system 100 also includes multiple spacers 110 able to couple two panels 102, when parallel, by entering the cavities 104 at the tops of the panels 102 and resting at the ends of the cavities 104. The cavities 104 may be at least as wide as the diameter of the spacers 110 at the top of the panels 102 and may form a semicircle configured to be flush with the spacers 110 at the bottom of the panels 102. By using spacers 110 of the same dimensions, but different thicknesses, the panels 102 may be used interchangeably to construct walls of different thickness in proportion to the different thickness of the spacers 110. In this way, variable spacer 110 thickness enables the construction of walls that meet architectural and structural requirements at an extremely low cost. The thickness of the spacers 110 used may be determined by the structural and architectural requirements of the resulting wall. For example, thicker spacers 110 may be used for retaining walls or multistory buildings. Thinner spacers 110 may be used for half walls, outdoor kitchen counters, sheds or fences. However, the same panels 102 may be used each application, driving costs down further.

In various embodiments, the spacers 110 may be cylinders having a radius of 5.4375 inches, and the spacers 110 may be made of expanded polystyrene or lightweight concrete. In at least one embodiment, the spacers 110 are made of 0.9 lb virgin expanded polystyrene. The spacers 110 may range in thickness between 3 inches to 12 inches depending on the structural requirements of the wall in at least one embodiment, and the shape of the spacers 110 may prevent cracks in the subsequently poured and hardened concrete due to the lack of sharp corners.

The variable spacer system 100 also allows for the manufacture of panels 102 of different thicknesses and composition to meet different requirements for exterior and interior walls. Electrical wiring and plumbing are installed by carving into interior walls. As such, interior panels 102 may be designed to be easily worked with conventional woodworking tools like drills, saws, and routers. Exterior panels 102 require greater insulation, waterproofing, and UV protection to protect exterior walls from the elements. Both interior and exterior panels 102 are designed to resist insects, rot, mold, and fire. Furthermore, a waterproofing layer and stucco base coat may be applied to exterior panels 102 prior to shipment to save labor cost on-site. Finally, both the panels 102 and spacers 110 may be constructed and treated to meet different construction requirements including insulation, water resistance, ultra-violet light resistance, insect resistance, increased workability with conventional woodworking tools, and the like.

The system 100 may also include fasteners 112, 118 to secure the spacers 110 to the panels 102 prior to pouring concrete. FIG. 1 shows two types of fasteners 112, 118. For example, the fastener 118 may include washers 122, with a slit in the center, used to secure the spacers 110 and panels 102. A first tie wrap 120 may be inserted through a fastening hole in the washers 122, and a second tie wrap 120 may be used to secure the first tie wrap 120. The washers 122 may be decoupled and reused in fastening assemblies 118 for other panels 102 after pouring concrete between the panels 102 thus driving costs even further down.

In at least one embodiment, the system 100 may include a fastening assembly 112 including a wire 114 and two washers 116. Each washer 116 may include two washer holes, and the wire 114 may be inserted through the washer holes. Specifically, the washers may be galvanized metal washers 116, with two holes in the center, used to secure the spacers 110 and panels 102. Assembly is the same as described above, but instead of a tie wrap, two pieces of galvanized bailing wire 114 (or a single wire folded over) are inserted through the fastening holes in the panels 102 and spacers 110. The ends of the two wires 114 run through separate holes in the washer 116. In at least one embodiment, the metal washers 116 are rectangular and bent up at each side. The bent ends serve two functions: to facilitate turning the washer 116 and to provide a fastening point for stucco mesh. As a washer 116 is turned, the two wires 114 twist, shortening their length and securing the panels 102 and spacer 110. The metal washers 116 remain in place, and the bent sides provide a gap for stucco mesh. The ends of the two wires 114 provide a means to attach stucco mesh to the panels 102.

The spacers 110 and panels 102 may be pre-configured with a fastening hole in their centers, and the fastening holes may be configured to align with each other when the spacers 110 rest at the ends of the cavities 104. In at least one embodiment, the locations of the fastening holes may be marked on the spacer 110 and the panels 102 for drilling on-site.

Figure 2:
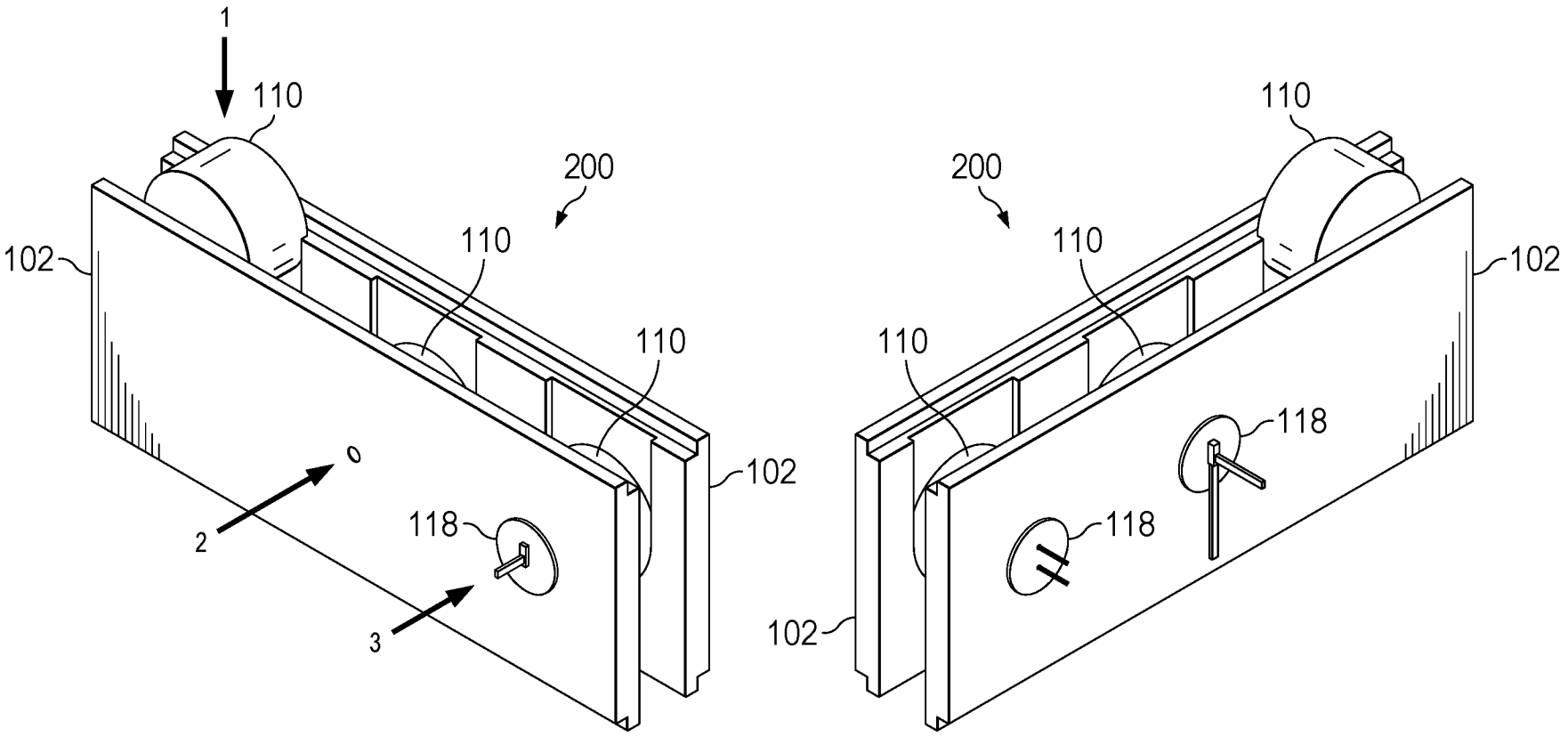
FIG. 2 is a diagram showing an illustrative fastening of spacers and panels into blocks.

FIG. 2 is a diagram showing an illustrative fastening of spacers 110 and panels 102 into blocks 200. A block 200 may include two panels 102, three spacers 110, and three fastening assemblies 118 in at least one embodiment. Plastic or metallic washers are secured to either end of the fastening holes with tie wraps. Specifically, a tie wrap is run through one washer, the exterior panel 102, the spacer 110, the interior panel 102, and a second washer. A second tie wrap fastens to the tail of the first tie wrap extending out of the second washer. The tie wrap ends may be cut and the washers reused for other panels 102 after pouring concrete as mentioned above. Once secured, the assembly of two panels 102 and spacers 110 is a block 200.

Figure 3:
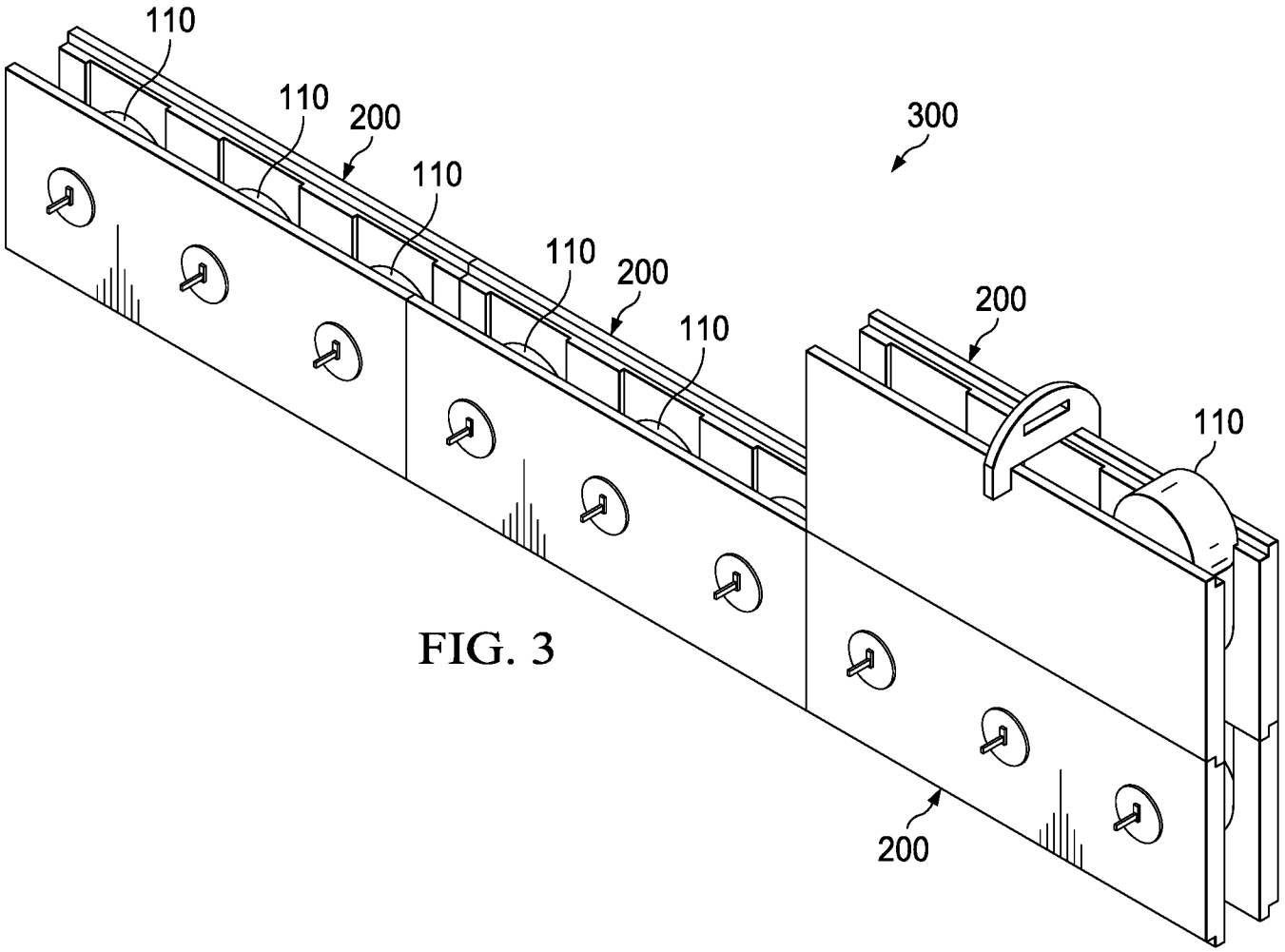
FIG. 3 is a diagram showing an illustrated stacking and arranging of blocks into a wall.

As shown in FIG. 3, a wall 300 may be formed by coupling blocks 200 and pouring concrete into the coupled blocks 200 on and around the spacers. Specifically, stacking blocks 200 on top of each other forms the wall 300 height, and arranging blocks 200 next to each other forms the wall 300 length. Each panel comprises opposite interlocking ridges at the top and bottom of the panel such that multiple panels may be stacked. The ridge at the top of the panel is adjacent to the panel's outside surface. The ridge at the bottom of the panel is adjacent to the panel's inside surface. When one block 200 is set on top of another, the ridge at the top of the lower block 200 restrains the ridge at the bottom of the upper block 200, preventing blow-outs when the concrete is poured.

Vertical reinforced bars, or rebar, stubs may be wet set into the foundation or drilled and glued after the foundation is poured. The stubs may stick up 24 inches above the foundation in at least one embodiment. Loops of wire or tie wraps may be placed around the stubs, between the first and second layer of blocks. Horizontal rebar may be placed between each block layer, and vertical rebar may be dropped down from the top of the wall and fastened to the stubs. Next, concrete may be poured into the blocks, specifically between the panels and on and around the spacers. After the concrete sets, the panels stay in place and become an integral part of the wall. Also, the ends of the tie wraps may be cut off and the plastic or metallic washers may be reused.

Figure 4:
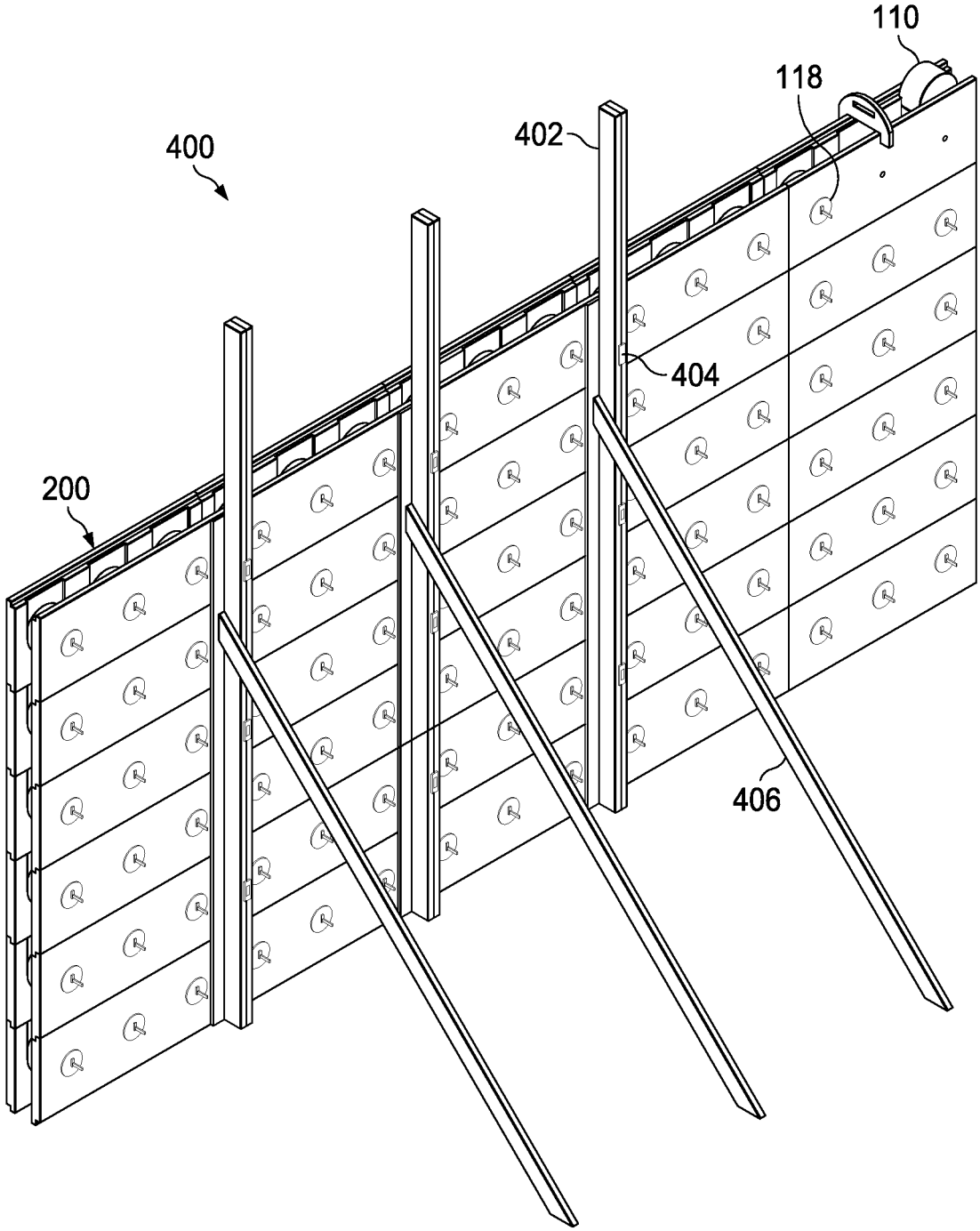
FIG. 4 is a diagram showing illustrative use of shoring to temporarily brace a wall.
Figure 5:
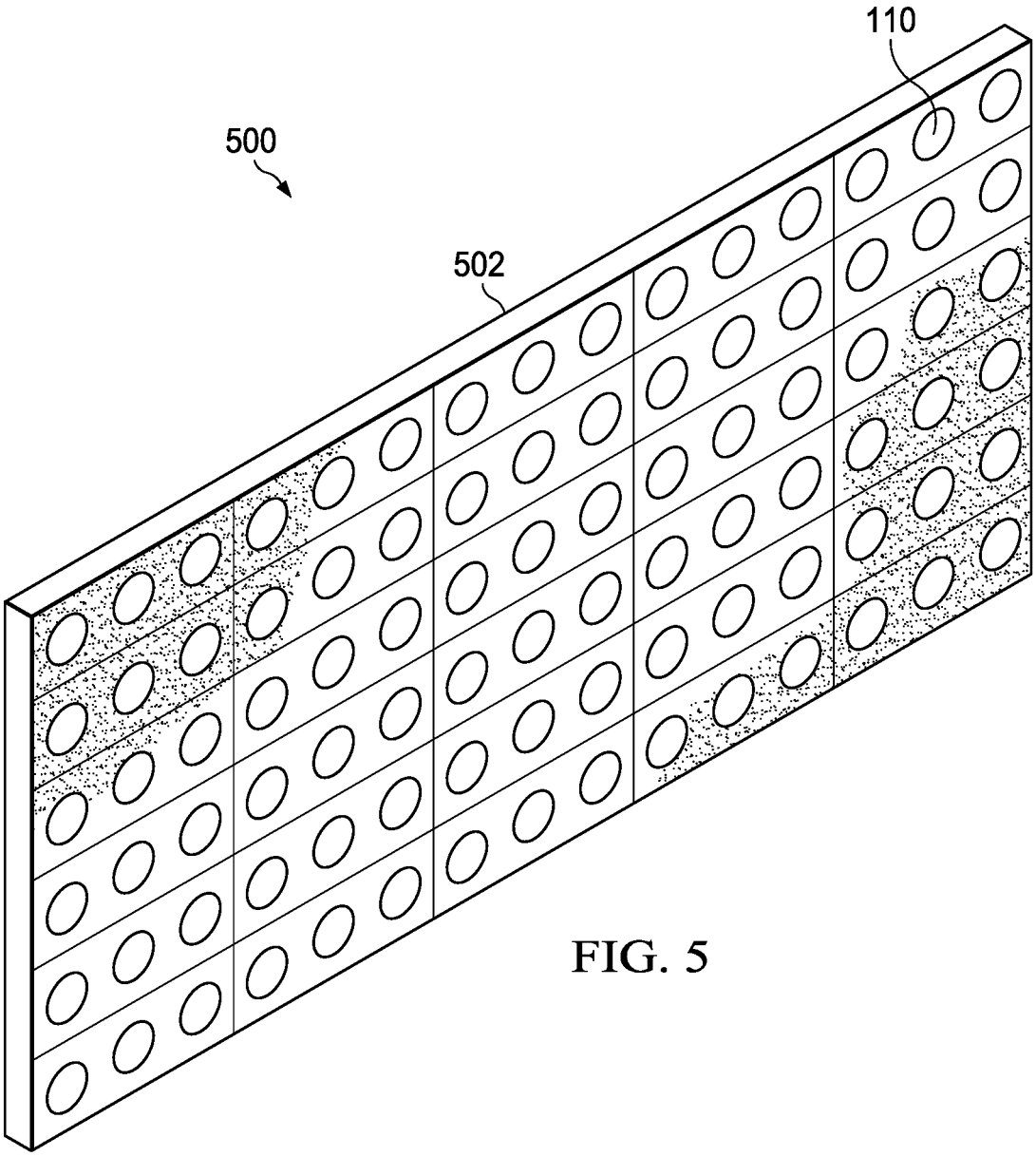
FIG. 5 is a diagram showing poured, reinforced concrete within an illustrative wall.

The stacked blocks 200 may be shored as shown in FIG. 4. In at least one embodiment, the blocks 200 are shored using fasteners 118, strong backs 402, and kickers 404 placed every four feet between the block 200 columns. For example, the strong backs 402 may be placed where the block 200 columns meet, and the kickers 406 may be placed where the block 200 rows meet. When concrete is poured within the blocks 200, the result is a structural grid 500 of reinforced concrete 502 and spacers 110 as shown in FIG. 5 with the panels omitted. The combination of reinforced concrete 502, lightweight spacers 110, interchangeable panels, and variable thickness spacers allow for the construction of incredibly low-cost walls for use in a myriad of applications.

Figure 6:
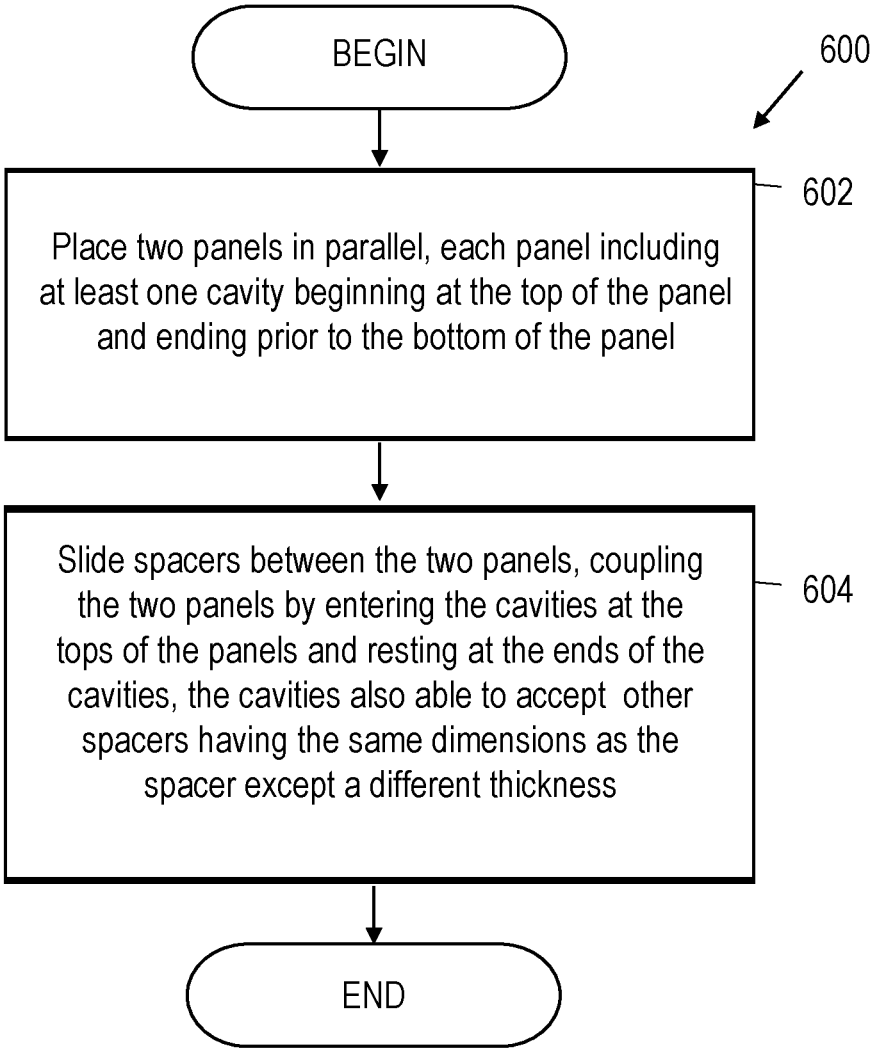
FIG. 6 is a flow chart showing an illustrative method of using the variable spacer system.

FIG. 6 is a flow chart showing an illustrative method 600 of using the variable spacer system. The method 600 may include installing vertical rebar stubs in the foundation at 16 inch intervals. Next, a block may be assembled. At 602, two panels are placed in parallel, each panel including at least one cavity beginning at the top of the panel and ending prior to the bottom of the panel. At 604, spacers are slid between the two panels, the spacers coupling the two panels by entering the cavities at the tops of the panels and resting at the ends of the cavities. The cavities are also able to accept other spacers having the same dimensions as the at least one spacer but a different thickness. Panels may vary in width and composition, depending on purpose. For example, thinner panels with no insulation may be used for low retaining walls or outdoor kitchen counters. Thicker panels may be used for exterior walls.

In at least one embodiment, the block is formed on-site. The method 600 may include drilling holes at the locations marked on the panels through both panels and the spacer between them. Next, the method 600 may include fastening the spacers between the panels using a fastening assembly, thus creating a block. Blocks may be similarly formed and arranged next to each other to form a row or course. When the course is complete, vertical rebar stubs may be installed into the course at the same interval in at least one embodiment. Subsequently, the next course may be prepared and installed on top of the previous course as described above.

The method 600 may further include forming multiple blocks, stacking blocks on top of each other to form a wall height, and placing blocks next to each other to form a wall length. In a pre-assembly method of construction, blocks are assembled and secured on the ground, then placed on the wall as a block. This results in efficient assembly. In an in-place method of construction, blocks are assembled on the wall, for example on top of, or adjacent to, other blocks. This results in easier assembly and handling of heavier blocks.

Stacking and placing blocks may include supporting the blocks with strong backs and kickers prior to pouring concrete into the blocks to stabilize and plumb the wall. Next, the method 600 may include inserting vertical rebar into the wall from the top and securing them to the foundations stubs. Next, the method 600 may include pouring concrete into the blocks on and around the spacers that form the blocks. The method 600 may further include removing the strong backs and kickers after pouring the concrete into the blocks.

As mentioned above, the variable spacer system panels 102 are made of lightweight concrete, which reduces shipping and handling costs. Panels 102 and spacers 110 are shipped separately to reduce damage and further lower shipping costs. A pallet consisting of entirely of panels 102 and another pallet of spacers 110, shipped separately, is 46% less volume than assembled blocks, requiring less space and having less susceptibility to damage than shipment of assembled blocks. Individual panels 102 and spacers 110 are lighter and easier to handle than assembled blocks, reducing labor fatigue. The variable spacer system enables shipping construction components separately, which decreases shipping cost and damage. Lightweight concrete panels 102 enable resistance to fire, insects, rot, and mold. The panels 102 also allow for easy installation of plumbing and electrical components. Additionally, the poured reinforced concrete grid enables less concrete to be used while simultaneously enabling higher strength and less damage from storms and floods. As such, the variable spacer systems and methods disclosed herein and described with respect to specific embodiments herein increases value while simultaneously reducing cost.

In some aspects, apparatuses, systems, and methods are provided according to one or more of the following examples:

Example 1

A variable spacer system of insulated concrete forms includes at least two panels, each panel including at least one cavity beginning at the top of the panel and ending prior to the bottom of the panel. The system further includes at least one spacer able to couple the two panels, when parallel, by entering the cavities at the tops of the panels and resting at the ends of the cavities. The cavities also accept at least one other spacer having the same dimensions as the spacer except a different thickness.

Example 2

A method of construction using insulated concrete forms includes placing two panels in parallel. Each panel includes at least one cavity beginning at the top of the panel and ending prior to the bottom of the panel. The method further includes sliding at least one spacer between the two panels. The spacer couples the two panels by entering the cavities at the tops of the panels and resting at the ends of the cavities. The cavities are able to accept at least one other spacer having the same dimensions as the spacer except a different thickness.

Example 3

A variable spacer system of insulated concrete forms includes panels, and each panel includes cavities beginning at the top of the panel and ending prior to the bottom of the panel. The system further includes spacers able to couple the panels, when parallel, by entering the cavities at the tops of the panels and resting at the ends of the cavities. The cavities also accept multiple other spacers having the same dimensions as the spacer except different thicknesses. Identical panels create walls of different thicknesses proportional to the thicknesses of the spacers used in the panels' cavities.

The following features may be incorporated into the various embodiments described above, such features incorporated either individually in or conjunction with one or more of the other features: The spacers may be cylinders both having a radius of 5.4375 inches. The spacers may be made of expanded polystyrene. The panels may create walls of different thickness based on the different thicknesses of the spacers. The thickness of spacer used may be determined by the structural and architectural requirements of the resulting wall. Each panel may include opposite interlocking ridges at the top and bottom of the panel such that multiple panels may be stacked to form a wall. The spacers and panels may be pre-configured with a fastening hole in their centers, and the fastening holes may be configured to align with each other when the spacers rest at the ends of the cavities. The system may include a fastening assembly including two tie wraps and two washers. The first tie wrap may be inserted through the fastening hole and washers, and the second tie wrap may be used to secure the first tie wrap. The washers may be decoupled and reused in fastening assemblies for other panels after pouring concrete between the panels. The system may include a fastening assembly, and the fastening assembly may include two wires and two washers. The wires may be inserted in parallel through the fastening hole and washer holes. The fastening holes may be marked on the spacer and the panels for drilling on-site. The cavities may be at least as wide as the diameter of the spacers at the top of the panels and may form a semicircle configured to be flush with the spacers at the bottom of the panels. A block may include two panels, three spacers, and three fastening assemblies. A wall may be formed by coupling blocks and pouring concrete into the coupled blocks. The method may include pouring concrete between the two panels on and around the at least one spacer. The method may include fastening the spacers between the panels using a fastening assembly, thus creating a block. The method may include forming multiple blocks, stacking blocks on top of each other to form a wall height, and placing blocks next to each other to form a wall length. The method may include pouring concrete into the blocks on and around the spacers that form the blocks. Stacking and placing blocks may include supporting the blocks with strong backs and kickers prior to pouring concrete into the blocks. The method may further include removing the strong backs and kickers after pouring the concrete into the blocks.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments in this disclosure have been described in terms of preferred embodiments, those skilled in the art will recognize that the embodiments herein can be practiced with modification within the spirit and scope of the embodiments as described herein. Numerous other modifications, equivalents, and alternatives, will become apparent once the above disclosure is fully appreciated. It is intended that the following claims be interpreted to embrace all such modifications, equivalents, and alternatives where applicable.

What is claimed is:

1. A variable spacer system of insulated concrete forms comprising:

at least two panels, each panel comprising at least one cavity beginning at the top of the panel and ending prior to the bottom of the panel; and at least one spacer able to couple the two panels, when parallel, by entering the cavities at the tops of the panels and resting at the ends of the cavities;

at least one other spacer able to couple the two panels, when parallel, by entering the cavities at the tops of the panels and resting at the ends of the cavities, the at least one other spacer having the same dimensions as the at least one spacer except a different thickness, wherein the at least one spacer, at least one other spacer, and at least two panels are pre-configured with a fastening hole, the fastening hole in the center of the at least one spacer and at least one other spacer, and the fastening hole in each panel configured to align with the fastening hole in the at least one spacer and the at least one other spacer when resting at the ends of the cavities; and a fastening assembly comprising two tie wraps and two washers, the first tie wrap to be inserted through the fastening hole and washers, and the second tie wrap to secure the first tie wrap, wherein the washers may be decoupled and reused in fastening assemblies for other panels after pouring concrete between the panels.

2. The variable spacer system of claim 1, wherein the at least one spacer and the at least one other spacer are cylinders.

3. The variable spacer system of claim 1, wherein the at least one spacer and the at least one other spacer are cylinders both having a radius of 5.4375 inches.

4. The variable spacer system of claim 1, wherein the at least one spacer and the at least one other spacer are made of expanded polystyrene or lightweight concrete.

5. The variable spacer system of claim 1, wherein the at least two panels create walls of different thickness based on the different thicknesses of the at least one spacer and the at least one other spacer.

6. The variable spacer system of claim 1, wherein the thickness of spacer used is determined by the structural and architectural requirements of the resulting wall.

7. The variable spacer system of claim 1, wherein each panel comprises opposite interlocking ridges at the top and bottom of the panel such that multiple panels may be stacked to form a wall.

8. The variable spacer system of claim 1, wherein fastening holes are marked on the spacer and the panels for drilling on-site.

9. The variable spacer system of claim 1, wherein the cavities are at least as wide as the diameter of the at least one spacer at the top of the panels and form a semicircle configured to be flush with the at least one spacer at the bottom of the panels.

10. The variable spacer system of claim 1, wherein two panels, including the at least two panels, three spacers, including the at least one spacer, and three fastening assemblies form a block, and wherein a wall is formed by coupling blocks and pouring concrete into the coupled blocks.

11. A method of construction using insulated concrete forms comprising:

placing two panels in parallel, each panel comprising at least one cavity beginning at the top of the panel and ending prior to the bottom of the panel; and sliding at least one spacer between the two panels, the at least one spacer coupling the two panels by entering the cavities at the tops of the panels and resting at the ends of the cavities, the cavities also able to accept at least one other spacer having the same dimensions as the at least one spacer except a different thickness, wherein the at least one spacer, at least one other spacer, and at least two panels a pre-configured with a fastening hole, the fastening hole in the center of the at least one spacer and at least one other spacer, and the fastening hole in each panel configured to align with the fastening hole in the at least one spacer and the at least one other spacer when resting at the ends of the cavities;

pouring concrete between the two panels on and around the at least one spacer;

fastening the at least one spacer between the two panels using a fastening assembly, thus forming a block, wherein the fastening assembly comprises two tie wraps and two washers, the first tie wrap inserted through the fastening hole and washers, and the second tie wrap securing the first tie wrap;

decoupling the washers from the fastening assembly; and reusing the washers in fastening assemblies for other panels.

12. The method of claim 11 further comprising forming multiple blocks, stacking blocks on top of each other to form a wall height, and placing blocks next to each other to form a wall length.

13. The method of claim 12, wherein stacking and placing blocks comprises supporting the blocks with strong backs and kickers prior to pouring concrete into the blocks, and further comprising removing the strong backs and kickers after pouring the concrete into the blocks.

14. A variable spacer system of insulated concrete forms comprising:

panels, each panel comprising cavities beginning at the top of the panel and ending prior to the bottom of the panel;

spacers able to couple the panels, when parallel, by entering the cavities at the tops of the panels and resting at the ends of the cavities, wherein the spacers and panels are pre-configured with a fastening hole, the fastening hole in the center of the spacers, and the fastening hole in each panel configured to align with the fastening hole in the spacers when resting at the ends of the cavities; and fastening assemblies comprising two tie wraps and two washers, the first tie wrap to be inserted through the fastening hole and washers, and the second tie wrap to secure the first tie wrap;

wherein the washers may be decoupled and reused in fastening assemblies for other panels after pouring concrete between the panels;

wherein the cavities also accept multiple other spacers having the same dimensions as the at least one spacer except different thicknesses; and wherein identical panels create walls of different thicknesses proportional to the thicknesses of the spacers used in the panels' cavities.

* * * * *